United States Patent [19]

Munn

[11] 4,081,180

[45] Mar. 28, 1978

[54] SKI HOLDING JIG

[76] Inventor: C. Johnny Munn, 69 S. Taft Hill Rd., Fort Collins, Colo. 80521

[21] Appl. No.: 776,160

[22] Filed: Mar. 10, 1977

[51] Int. Cl.[2] ..... B25B 1/20

[52] U.S. Cl. ..... 269/88; 269/285; 269/296; 269/321 W

[58] Field of Search ..... 269/321 W, 43, 88, 296, 269/285, 252

[56] References Cited

U.S. PATENT DOCUMENTS

| | | | |
|---|---|---|---|
| 3,826,482 | 7/1974 | Tourangeau | 269/321 W |
| 3,921,967 | 11/1975 | Campbell | 269/321 W |

*Primary Examiner*—Robert C. Watson

*Attorney, Agent, or Firm*—Henderson, Strom, Sturm, Cepican & Fix

[57] ABSTRACT

A portable ski holding jig including a vise unit and a pair of movable supporting units which are disposed on opposite sides of the vise unit to support the ends of a ski on either its edge or on either side.

6 Claims, 7 Drawing Figures

SKI HOLDING JIG

BACKGROUND OF THE INVENTION

This invention relates to a ski holding jig for supporting the ski when it is sanded, waxed or the like. Prior art jigs have been complex, heavy and they are normally permanently secured to a work table. In addition, these jigs will not support a ski in any position, that is with an edge up, the bottom up or the top up, without considerable effort or with the use of auxiliary parts. These jigs are not adapted for ready portability and skiers in general have avoided taking them on skiing trips. As a result any repairs or ski preparation required at the ski slope was difficult to accomplish or not done at all. In the latter event, the enjoyment normally associated with skiing was affected and possibly hazardous situations were established.

BRIEF SUMMARY OF THE INVENTION

This invention relates to a portable ski holding jig having a vise unit and a pair of normally spaced support units wherein the support units can be spaced outwardly of the vise unit during use and which can be nested with the vise unit for storage and/or transport. In addition, the jig is adapted to securely hold a ski with any of its surfaces or edges projecting upwardly without the use of any auxiliary equipment or tools.

It is an object of this invention to provide a ski holding jig which will securely hold a ski with any of its surfaces or edges in an upright position.

Another object of this invention is the provision of a ski holding jig which in a first mode is extremely effective in holding a ski and in a second mode is extremely compact and portable.

Yet another object of this invention is to provide a ski holding jig which is economical to manufacture, simple and durable of construction, light in weight, portable and extremely effective in service.

These objects and other features and advantages of this invention will become more readily apparent upon reference to the following description when taken in conjunction with the accompanying drawings.

DESCRIPTION OF THE PREFERRED EMBODIMENTS

Figure 1:
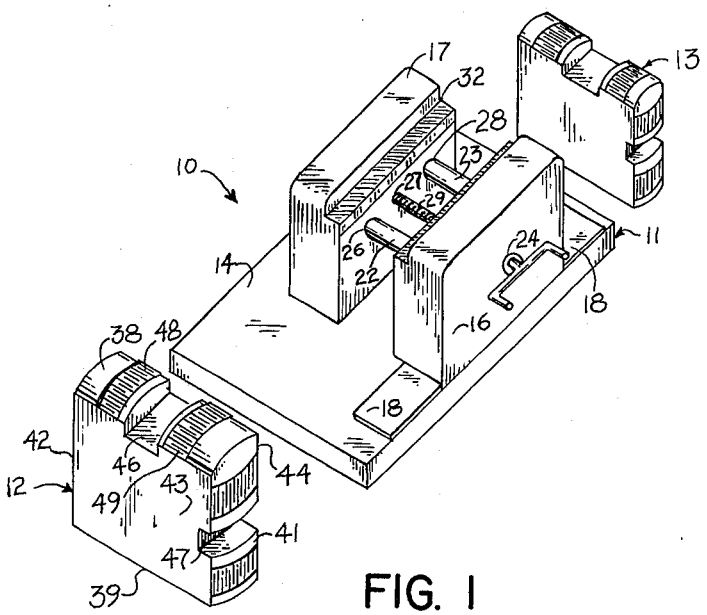
FIG. 1 is a perspective view of the ski holding jig of this invention in a use position.

Referring now to the drawings, and in particular to FIG. 1, the ski holding jig of this invention is referred to generally by the numeral 10. The jig includes three units, a vise unit 11, and a pair of supporting units 12 and 13. The units 11–13 are preferably constructed of lightweight material, and plastic is extremely effective because it is durable, light in weight and inexpensive.

Figure 2:
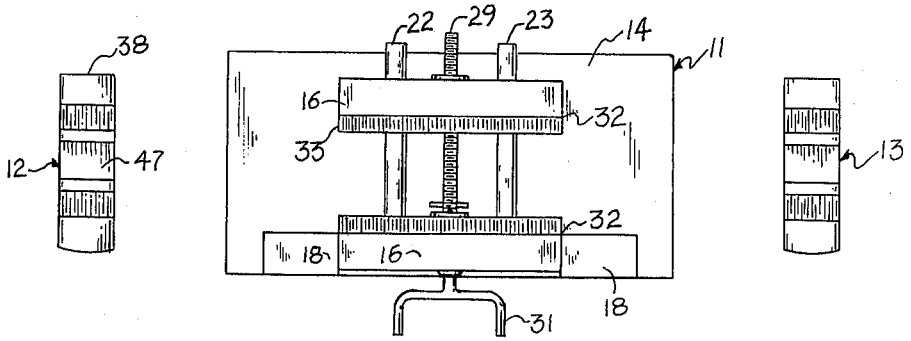
FIG. 2 is a top plan view thereof.
Figure 3:
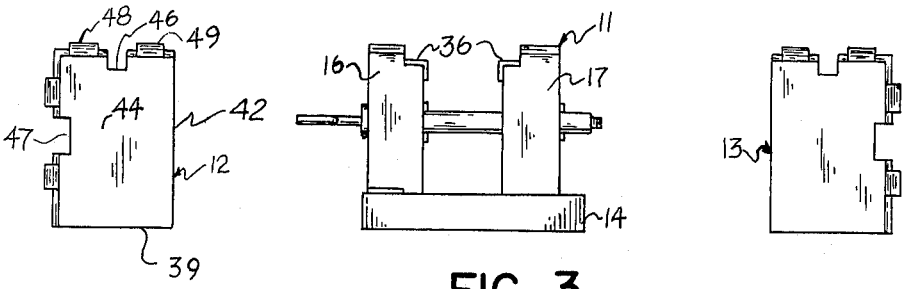
FIG. 3 is an end elevational view thereof with each element turned 90° from its FIG. 2 position.

The vise unit 11, (FIGS 1 and 2) has a rectangular, generally flat base 14 and a pair of spaced hexahedron, upstanding posts 16 and 17, wherein one of the posts 16 is secured to the base 14 by epoxy, screws or the like and the other post 17 is slidable disposed on the base. In FIG. 2 it will be noted that the base extends longitudinally of the posts and metal plates 18 are secured thereto proximate each longitudinal edge of the fixed post. The plates are provided to receive one jaw of a C-clamp 19 or the like in the event it is desired to secure the base to a work table (not shown).

Secured to and spaced apart on the fixed post 16 FIGS. 1 and 2, are the ends of a pair of parallel shafts 22 and 23 having free ends which project laterally of the post. A hole 24 is drilled through the fixed post intermediate the shafts and parallel thereto.

The movable post 17 (FIGS. 1 and 2) has three holes 26, 27 and 28 drilled laterally therethrough in axial alignment with the shafts 22 and 23 and the hole 24 in the fixed post 16. The center hole 27, in alignment with the fixed post hole 24 is tapped. Slidably mounted in hole 24 and threadably mounted in the hole 27 is a threaded bolt 29 having a wing head 31 on its shank end. The shafts 22 and 23 are slidably disposed in the holes 26 and 28. Rotation of the bolt 29 will cause the movable post 17 to move toward or away from the fixed post depending upon the direction of rotation.

The top wall 31 (FIGS. 1 and 2) of each post 16 and 17 has an offset 32 formed therein along the top and side facing the other post. The offsets are L shaped with the horizontal surface 33 of each being coplaner and the vertical surface 34 of each being parallel and facing each other. Secured to each offset is an L-shaped pad 36 for protecting the surfaces of a ski 37 when it is disposed therebetween.

Positioned proximate each end of the base 14 (FIGS. 1 and 2) are the supporting units 12 and 13. Each unit 12 and 13 are identical therefore only one will be described. Referring now to the drawings, the unit 12 is a hexahedron having a top wall 38, a bottom wall 39 a top side wall 41, a bottom side wall 42, and a pair of side walls 43 and 44. The top wall 38 and the top side wall 41 each have a centrally disposed notch 46 or 47, respectively formed therein which extends laterally from side wall 43 to side wall 44. The surfaces extending between the sidewall of both top wall and top side wall 38 and 41 are arcuate. Resilient pads 48 and 49 are mounted on the top wall and top side wall 38 and 41. The height of each side wall 43 and 44 is less than the length thereof therefore when the supporting unit 12 or 13 is disposed on the bottom side wall 42 the top side wall 41 is higher than the top wall 38 when the unit 12 or 13 is disposed on the bottom wall 39.

Figure 4:
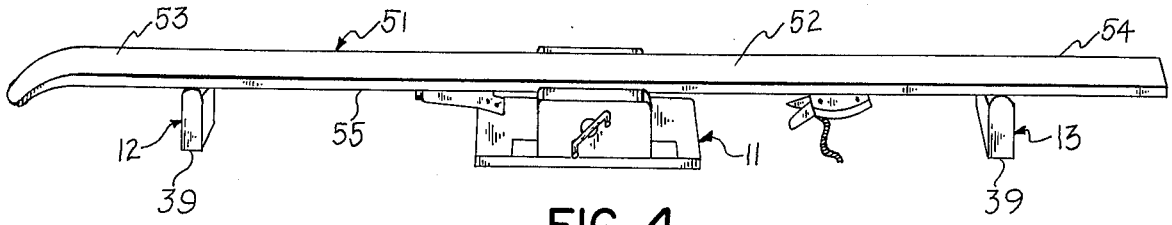
FIG. 4 is a perspective view with the jig holding a ski with the bottom surface thereof projecting upwardly.

In use the vise unit 11 (FIGS. 4–6) is disposed on a surface and the supporting units 12 and 13 are placed one on each end of the vise unit. A ski 51 generally is convex, in side elevational view, therefore when the bottom surface 52 is positioned face up (FIG. 4) the ends 53 and 54 of the ski project above the center section of the ski. It will thus be noted that the supporting units 12 and 13 are disposed on their bottom wall 39 with the top surface 55 of the ski proximate its ends disposed thereon and the edges 56 and 57 of the center section disposed on the horizontal surfaces 33 and gripped between the vertical surfaces 34 of the offsets 32.

Figure 5:
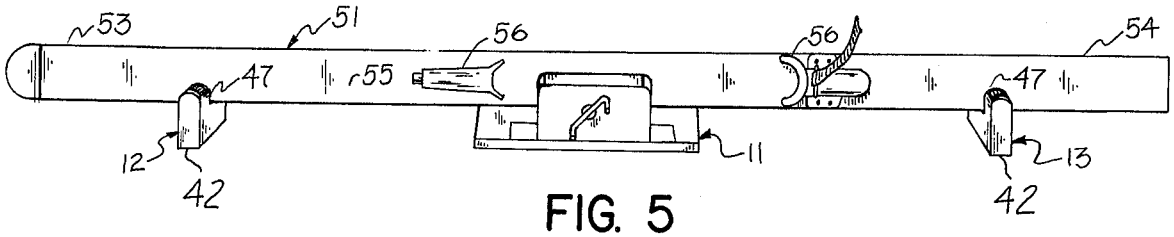
FIG. 5 is a perspective view with the ski having an edge projecting upwardly.
Figure 6:
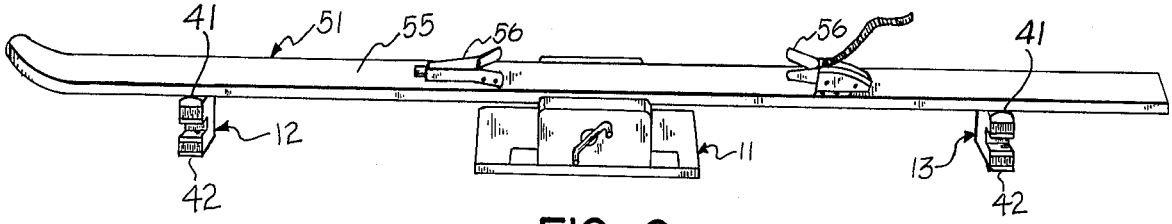
FIG. 6 is a perspective view with the top surface of the ski projecting upwardly.

If the ski is disposed with its top surface 55 and binding 56 projecting upwardly the convexity requires shorter supporting units and they are turned to rest on the bottom side wall 42 with the ends of the skis resting on the top side wall 41 (FIG. 6). In FIG. 5 the ski is disposed with an edge projecting upwardly therefor the supporting units are turned to a FIG. 4 position and the edge of the ski is disposed in the notch 47. Again the notches, top and top side wall can be used in any manner depending on the surface upon which they are placed and upon the configuration of the ski.

Figure 7:
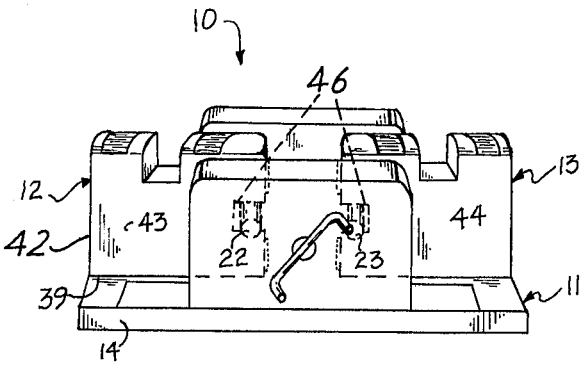
FIG. 7 is a perspective view of the jig in a transport position.

In FIG. 7 the jig 10 is depicted in a transport position with the bottom side wall 42 disposed on the base 14, with the shafts 22 and 23 nested in the notch 46 and with the posts engaging the side walls 43 and 44. The preferred embodiment of the jig is made of plastic or the like and in a transport position the jig takes a minimum of space, is easily packed or stored, and is easily transported.

I claim:

1. A ski holding jig comprising:

a vise unit having a base, an upstanding fixed post secured to said base, a movable upstanding post slidably disposed on said base and connectable with said fixed post for securing a ski therebetween, wherein each post has an offset formed in its upper surface along one edge thereof, said offsets being disposed facing each other for supporting a portion of the ski thereon and for gripping a portion of the ski therebetween, said offsets having a substantially vertical face and a substantially horizontal face with said horizontal face disposed a predetermined distance above said base;

a pair of guide bars disposed normally to said posts, wherein said guide bars are secured to said fixed post, and through holes provided therefore in said movable post; and a pair of supporting structures separable from and disposed one on each side of said vise unit for supporting the ends of the ski, wherein said base projects longitudinally of said posts toward said supporting structures and each said supporting structure is a hexahedron having a top wall, a bottom wall, a top side wall, a bottom side wall, and a pair of side walls.

2. A ski holding jig as defined in claim 1 wherein the height of said top wall when it is projecting upwardly is less than the height of said horizontal faces of said offsets.

3. A ski holding jig as defined in claim 2 wherein the height of said top side wall when it is projecting upwardly is greater than the height of said horizontal faces of said offsets.

4. A ski holding jig as defined in claim 3 and said top wall and said top side wall each have a centrally disposed notch formed therein and extending laterally thereacross and normal to said pair of side walls, wherein said notch in said topwall will support the edge of a ski disposed on its side, and said notch in said top side wall will engage said guide bars.

5. A ski holding jig as defined in claim 4 and said top wall and said top side wall each have arcuate edges which extend from said side wall to said side wall.

6. A ski holding jig as defined in claim 5 and each said top wall, said top side walls, and said vertical and horizontal faces of said vise unit have a resilient pad mounted thereon.

* * * * *